United States Patent [19]

Moltrasio

[11] Patent Number: 4,976,583

[45] Date of Patent: Dec. 11, 1990

[54] METHOD FOR UNBINDING A STACK OF SACKS

[76] Inventor: Mario Moltrasio, Via Ruvigliana, 12, Viganello, Switzerland

[21] Appl. No.: 470,910

[22] Filed: Jan. 26, 1990

[30] Foreign Application Priority Data

Jan. 31, 1989 [IT] Italy ..... 19266 A/89

[51] Int. Cl.[5] ..... B72D 7/02; B65B 69/00

[52] U.S. Cl. ..... 414/786; 414/412; 414/797; 83/142; 83/909

[58] Field of Search ..... 414/411, 412, 786, 756.9, 414/797; 83/112, 142, 425, 869, 909

[56] References Cited

U.S. PATENT DOCUMENTS

| | | | |
|---|---|---|---|
| 2,858,009 | 10/1958 | Bainbridge | 414/797 X |
| 3,404,787 | 10/1968 | Hayford | 414/797 X |
| 4,348,801 | 9/1982 | Dumont et al. | 83/909 X |
| 4,390,313 | 6/1983 | Hoehn | 414/412 |
| 4,439,093 | 3/1984 | Victorino | 414/797 X |
| 4,451,967 | 6/1984 | Stobb | 83/909 X |
| 4,457,123 | 7/1984 | Hoehn | 414/412 X |
| 4,553,312 | 11/1975 | Mitzel et al. | 83/909 X |
| 4,660,818 | 4/1987 | Conner et al. | 83/909 X |
| 4,696,615 | 9/1987 | Ettischer et al. | 414/412 X |
| 4,718,157 | 1/1988 | Keyzers et al. | 83/909 X |
| 4,835,836 | 6/1989 | van Vitert | 83/909 X |
| 4,838,751 | 6/1989 | Hanaya et al. | 83/909 X |
| 4,927,318 | 5/1990 | Haydon et al. | 414/792 X |

FOREIGN PATENT DOCUMENTS

| | | | |
|---|---|---|---|
| 3637114 | 5/1988 | Fed. Rep. of Germany | 414/797 |
| 52-39492 | 3/1977 | Japan | 414/412 |
| 53-71995 | 6/1978 | Japan | 414/412 |
| 1-111642 | 4/1989 | Japan | 414/412 |

*Primary Examiner*—Robert J. Spar
*Assistant Examiner*—Robert S. Katz
*Attorney, Agent, or Firm*—Steinberg & Raskin

[57] ABSTRACT

The sacks bound into packs by straps are unbound during their travel towards a sack application device by cutting the strap or straps which bind them, making the cut in a portion of the strap or straps which has been spaced apart from the pack. The cut straps are removed from the unbound pack, which then reaches the sack application device. The arrangement comprises conveyors for conveying the bound sacks to a station for cutting and removing the strap or straps, and from this to a sack application device.

8 Claims, 2 Drawing Sheets

METHOD FOR UNBINDING A STACK OF SACKS

DESCRIPTION

This invention relates to a method for supplying sacks of any type, whether of glued or sewn, open mouthed or valve type, to a sack application device, the known purpose of which is to apply said sack to the delivery nozzle or mouth for the powder or granular material which is to form the sack contents. Both sack application devices and sack filling machines possessing delivery nozzles or mouths are well known, especially in the cement industry, where such sacks are filled with cement.

This invention also relates to the arrangement for implementing the method.

With particular but not exclusive reference to the cement industry, it is well known that the handling of the empty sacks involves a human element which negatively affects the costs of the sack filling operation.

The main object of the present invention is therefore to reduce the costs of a sack filling plant for the sector concerned, and particularly for a cement factory, by reducing the labour currently required, accelerating the handling of the empty sacks, and increasing the self-sufficiency of the sack filling machines. This and further objects which will be apparent from the detailed description given hereinafter are attained by a method substantially whereby the sacks bound into packs are unbound by cutting the binding during this travel towards the sack application device, by forming a region of separation between the binding and the packs and making the binding cut in the separation region, then removing the cut binding.

The arrangement for implementing the stated method comprises means for feeding the bound pack of sacks to a cutting means, means for forming a region in which the binding is separated from the pack so as to expose that region in which the binding is separated from the pack to the cutting means, means for removing the cut binding from the pack and means for conveying the unbound pack to the sack application device.

According to an advantageous and important embodiment of the device, a depalletizing apparatus of known type is disposed upstream of the cutting means.

The invention will be more apparent from the detailed description of a preferred embodiment thereof given hereinafter by way of non-limiting example and illustrated on the accompanying drawing, in which.

Figure 1:
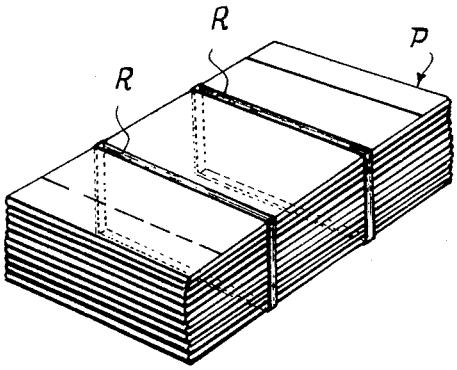
FIG. 1 is a perspective schematic view of a pack of sacks bound with a binding in the form of two conventional straps.
Figure 3:
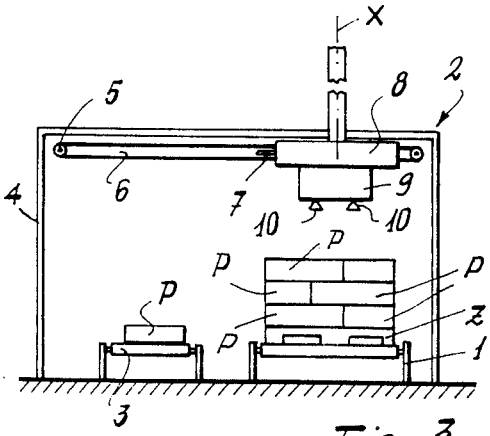
FIG. 3 is a schematic view in the direction of the arrow A of FIG. 2.

The sacks are produced by specialist industries, i.e. by sack factories, on the basis of a substantially automatic cycle. The sacks are grouped, for example automatically, into packs. The packs are transferred to a conventional strapping machine which binds them. The bound pack, indicated by P, is shown in FIG. 1, the binding being formed from two straps indicated by R. The packs P are disposed in layers on a conventional pallet, shown in FIG. 3 where it is indicated by Z. Each layer comprises a predetermined pack arrangement. To place the packs P on the pallet Z a known palletizer can be used, such as of the type described in another patent in the name of the present application, for placing full sacks on a pallet.

In known manner, the assembly of packs situated on the pallet Z is fastened to the pallet to prevent any displacement of the packs during their transportation. In some cases a plastic wrapping, such as of heat-shrinkable type, can also be provided to protect the packs from the weather.

The loaded pallet is despatched by conventional means of transport such as trucks to the sack filling plant, for example of the cement factory. It is here unloaded and the means used for fastening the pack assembly to the pallet and the possible heat-shrinkable protective wrapping are removed. The pallet Z together with the assembly of packs P is loaded onto a roller conveyor 1 which conveys it to a depalletizing station 2 of known type, the purpose of which is to unload the packs P from the pallet Z one by one and to transfer them to another conveyor 3, such as of roller type, arranged parallel to the preceeding.

In the non-limiting example considered here, the withdrawal and transfer station 2, i.e. the depalletizer, comprises a load-bearing structure 4 of bridge shape extending over the two conveyors 1, 3. The structure 4 carries longitudinal guides 5, i.e. paralell to the conveyors, along which a carriage or slide 6 can move in both directions driven by conventional motor means, not shown. The carriage 6 comprises guides, only partly reproduced and indicated by 7, along which a further carriage or slide 8 can move in both directions. This latter therefore moves in a direction perpendicular to the movement of the carriage 6 and conveyors 1, 3, driven by conventional motor means, not shown.

The carriage 8 lowerly carries a head 9 provided with suckers 10 for gripping the packs P.

The head 9 is not only able to rotate about a vertical axis X but is also able to move upwards and downwards. Conventional motor means, not shown, effect these movements of the head 9.

By virtue of the described construction, the station 2 is able to withdraw one pack P at a time from the pallet Z and transfer it to the conveyor 3.

Before it reaches a station 11 for the cutting and removal of the binding, the pack P which has arrived on the conveyor 3 is centered on said conveyor by adjustable stationary lateral guides 12. The conveyor 3 terminates at the entry to the station 11, in which the pack P is made for example to advance by two endless parallel belts 13 driven by conventional motor means, not shown. For the purpose of supporting and moving the packs, the belts 13 are provided with projecting appendices 13B on which the pack P rests.

Figure 4:
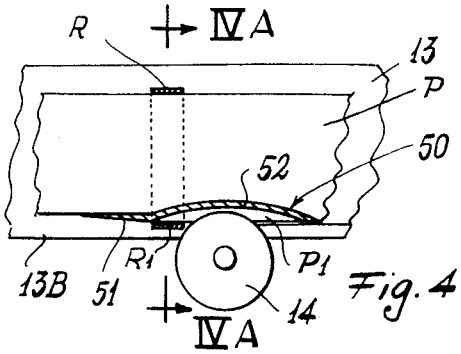
FIG. 4 is a schematic partial longitudinal section on the line IV—IV of FIG. 2.
Figure 4A:
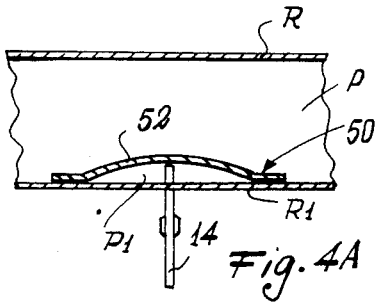
FIG. 4A is a schematic longitudinal section on the line IVA—IVA of FIG. 4 through a detail of the cutting means just before they act on the binding.
Figure 5:
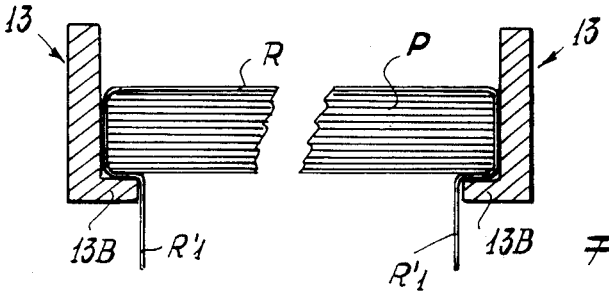
FIG. 5 is a schematic section on the line V—V of FIG. 2 after the pack binding has been cut.

During its advancement, the pack P encounters a stationary member 50, for example of sheet metal, the purpose of which is to insert its thinned or tapered front end 51 between the lower side R1 of the straps and the pack P (FIGS. 4 and 4A) in order to form, by means of its hollw or arcuate rear part 52, a separation region P1 thereat between the pack P and the side R1, in which a rotary blade 14 can operate to cut said side. In addition, the rear part 52 of the member 50 protects the pack from the blade. After the side R1 has been cut it produces two free ends R'1 (FIG. 5).

Figure 6:
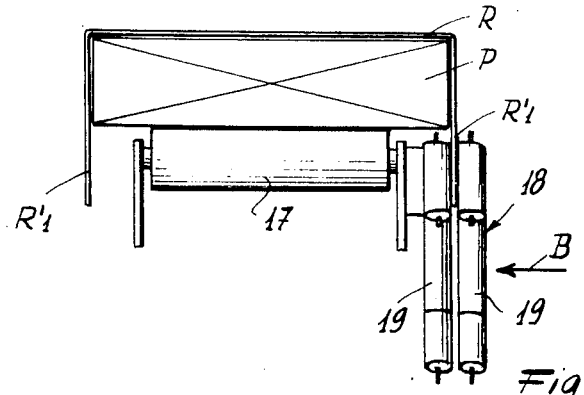
FIG. 6 is a schematic section on the line VI—VI of FIG. 2 during the stage in which the cut binding is being removed from the pack of sacks.

On leaving the belts 13, the pack is carried on a roller conveyor 17 having a width less than the width of the pack P and such that the free ends R'1 of the binding hang freely to the side of the pack, as shown in FIG. 6.

Figure 2:
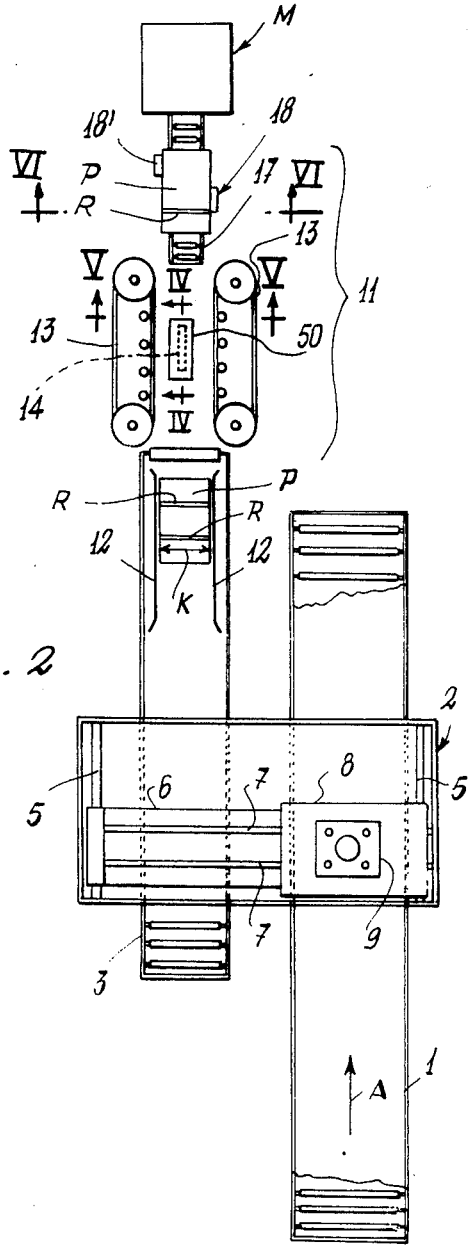
FIG. 2 is a plan view of the arrangement of the invention.
Figure 7:
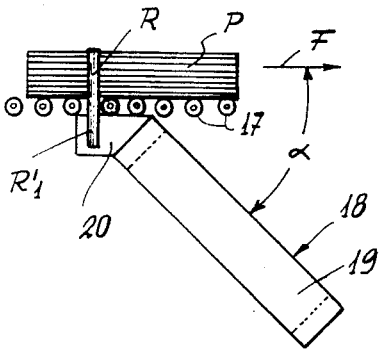
FIG. 7 is a schematic view in the direction of the arrow B of FIG. 6.

To the side of the conveyor 17 (see FIGS. 2, 6 and 7) there is provided a means for removing the cut bindings R from the pack P. This means is indicated overall by 18 and comprises in this example a pair of belts 19 which are very close together and are driven at speed exceeding that with which the pack P advances along the conveyor 17. The belts 19 are arranged as follows:

(a) inclined to form an acute angle (alpha) to the direction F of advancement of the pack P, and (b) such that one of the free ends R'1 of the binding R can be gripped between the two belts 19 and removed from the pack. To facilitate the insertion of the end R'1 between the belts 17, lead-ins such as those indicated by 20 can be provided. To ensure that the binding is removed if the belts 19 fail, an identical device (indicated by 18' in FIG. 2) can be located on the other side of the conveyor 17, but more downstream than the device 18 to which the belts 19 pertain.

The unbound pack now free of its binding then passes to a conventional sack application device indicated by M. The invention also covers an embodiment in which the part which unbinds the packs is incorporated into or forms an integral part of the sack application device.

I claim:

1. A method for supplying a stack of sacks which are bound into packs by at least one binding, to a sack application device for the purpose of applying the sacks to a delivery nozzle for granular material which is to form the sack contents, characterized in that the packs (P) are unbound either in the sack application device or during their travel towards this device by the steps of: first forming a region (P1) in which the binding (R) is separated from the packs (P), then making a cut in the binding (R) in said region (R1), and then removing the cut binding while the sacks remain in said stacked configuration.

2. A method as claimed in claim 1, characterised in that the bound packs (P) are disposed in layers, each layer is configured in a predetermined arrangement, on a pallet (Z) disposed on a first conveyor means (1), and are withdrawn therefrom individually to be transferred onto a second conveyor means (3, 13, 17) which conveys them to the sack application device (M), the packs (P) being unbound while on this second conveyor means.

3. An arrangement for implementing the method claimed in claim 1 further characterised by comprising feeding means (3, 13) for feeding the bound (by R) pack (P) of sacks to a cutting means (14), means for forming a region (P1) in which the binding (R) is separated from the pack (P) so as to expose said region (R1) in which the binding is separated from the pack (P) to the cutting means (14), means (18) for removing the cut binding (R, R'1) from the pack and means (13, 17) for transferring the unbound pack to the sack application device (M).

4. An arrangement as claimed in claim 3, further characterised by including an apparatus (2) for transferring individual packs (P) from a pallet (Z), on which they are disposed in layers in a predetermined arrangement, to said feeding (3,13).

5. An arrangement as claimed in claim 4, further characterised in that the pallet (Z) is driven by said first conveyor means (1).

6. An arrangement as claimed in claim 1, further characterised by including a rotary blade cutting means for making said cut in the binding.

7. An arrangement as claimed in claim 1 further characterised in that the cut binding (R) is removed from the pack (P) by gripping a free end (R'1) with cooperating mobile belts (18).

8. An arrangement as claimed in claim 3, further characterised in that the means for forming a region in which the binding is separated from the pack comprise a stationary member (50) which is inserted between the binding (R) and the pack (P) and is shaped (52) such as to form said region (P1) in which they are separated from each other to enable a cutting means (14) to cut the binding (R).

* * * * *